United States Patent [19]

Nishijima et al.

[11] 4,059,452

[45] Nov. 22, 1977

[54] METAL SURFACE TREATMENT

[75] Inventors: Masanori Nishijima; Nobuyuki Oda, both of Yokohama; Haruyoshi Terada, Tanashi, all of Japan

[73] Assignee: Oxy Metal Industries Corporation, Warren, Mich.

[21] Appl. No.: 544,616

[22] Filed: Jan. 28, 1975

[30] Foreign Application Priority Data

Jan. 28, 1974 Japan ..... 49-10960

[51] Int. Cl.[2] ..... C09D 5/08; C23F 7/26

[52] U.S. Cl. ..... 106/14; 148/6.2

[58] Field of Search ..... 106/14; 148/6.2

[56] References Cited

U.S. PATENT DOCUMENTS

| | | | |
|---|---|---|---|
| 3,472,681 | 10/1969 | Schuster et al. | 148/6.2 |
| 3,535,167 | 10/1970 | de Ridder et al. | 148/6.2 |
| 3,578,508 | 5/1971 | Pearlman | 148/6.2 |
| 3,664,883 | 5/1972 | Henry | 148/6.2 |
| 3,679,493 | 7/1972 | Beiswanger et al. | 148/6.2 |
| 3,687,739 | 8/1972 | Kennedy et al. | 148/6.2 |
| 3,718,509 | 2/1973 | Germano | 148/6.2 |
| 3,779,815 | 12/1973 | Hamilton et al. | 148/6.2 |

*Primary Examiner*—Lorenzo B. Hayes

*Attorney, Agent, or Firm*—Arthur E. Kluegel; Richard P. Mueller; Bertram F. Claeboe

[57] ABSTRACT

Disclosed is a method of coating a metal surface by contacting it with an aqueous acidic solution containing hexavalent chromium and either a non-ionic surfactant having the formula $$RO(CH_2CH_2O)_nH$$

wherein

R = a saturated or unsaturated aliphatic radical of 5 to 25 carbon atoms $n$ = 2 to 30 or glycine followed by drying and baking the surface. Preferably, the solution also contains urea.

6 Claims, No Drawings

METAL SURFACE TREATMENT

BACKGROUND OF THE INVENTION

This invention relates to a composition and process for treating a metal surface to form a chromate coating.

It is an object of this invention to improve metal corrosion resistance and properties after painting by providing a coating having excellent corrosion resistance and paint base properties. The metals include, for example, iron, steel, zinc, galvanized steel plate, aluminum, magnesium, cadmium and alloys thereof.

Chromate coatings have conventionally been employed to improve the corrosion resistance of the bare metal surface and as a paint base coating for enhanced corrosion resistance on aluminum, zinc, galvanized steel plate, tin plate and the like and as a sealing, anticorrosive or coating on iron or steel pretreated with a phosphatizing solution and as an insulating or antiocorrosive coating for electrolytic iron plate. As the chromating solution, there have been employed chromic acid together with aminoalcohols, polyvalent alcohols, fatty acids and the like as a reducing agent suitable for the acid. However, such coatings have been unsuccessful because they have unsatisfactory corrosion resistance and adhesion of topcoated paints.

SUMMARY OF THE INVENTION

It has now been found that improved corrosion resistance and adhesion of topcoated paints can be achieved by coating a metal surface with a chromating solution comprising (1) a hexavalent chromium compound, (2) one or more compounds selected from the group comprising: (a) non-ionic surface active agents having the general formula of $RO—(CH_2CH_2O)_nH$ wherein R represents a saturated or unsaturated aliphatic hydrocarbon group of 5 to 25 carbon atoms and *n* represents an integer from 2 to 30 and (b) glycine, followed by drying and baking the applied coating. Preferably, the solution also contains urea.

DETAILED DESCRIPTION OF THE INVENTION

Hexavalent chromium compounds useful in this invention include, for example, chromic anhydride, alkali metal or ammonium chromates such as ammonium dichromate, sodium dichromate and chromates such as sodium chromate and ammonium chromate. The chromium compounds may be employed in a concentration ranging from 1 to 200 grams of hexavalent chromium per liter of solution and preferably in a concentration ranging from 5 to 50 grams of the hexavalent chromium per liter.

The non-ionic surface active agents useful in this invention have the general formula of $RO—(CH_2CH_2O)_nH$ and include, for example, polyoxyethylene lauryl ethers, polyoxyethylene tridecyl ethers and polyoxyethylene oleyl ethers. R represents a saturated or unsaturated aliphatic hydrocarbon radical which may be straight chained or branched and which contains 5 to 25 carbon atoms and preferably 10 to 18 carbon atoms. When the number of carbon atoms is less than 5, the surface active agent has no wetting property, and when the number of carbon atoms is greater than 25, the surface active agent is not readily available. The value of *n* may range from 2 to 30, preferably from 3 to 16. When *n* is less than 2, the surface active agent is insufficiently soluble in water and when *n* is larger than 30, the surfactant does not possess the desired properties. The ratio of R to ethylene oxide is selected so that the HLB (hydrophilic-lipophilic balance) of the surfactant falls within the range from 4 to 19. The concentration of the non-ionic surfactant as a reducing agent under wetting condition is 1 to 30 grams/liter, preferably 1 to 20 grams/liter and at such concentrations, 20 to 90% of the hexavalent chromium can be reduced to trivalent form.

The concentration of glycine usable in this invention may be 1 to 50 grams/liter, preferably 5 to 50 grams/liter. The proportion of hexavalent chromium to the non-ionic surfactant ranges from 50:1 to 1:1, preferably from 10:1 to 2:1. The proportion of hexavalent chromium ion to glycine ranges from 50:1 to 1:1, preferably 10:1 to 2:1. The chromating solution is prepared by dissolving a hexavalent chromium compound, non-ionic surface active agent and/or glycine in water, followed by adjusting the pH to a value ranging from 0 to 7, preferably from 0 to 4.

If desired, there may be added in the chromating solution a cation such as Al, Mg, Ni, Zn, Cu, Fe, Mn, Co, Mo, Ti and V as an oxide such as $Z_nO$, a sulfide such as $MoS_2$ or a salt such as a phosphate.

The chromating solution according to this invention may be applied to a clean metal surface by any coating procedure such as immersing, pouring, brushing or roll coating followed by drying and baking to form a film having improved corrosion resistance.

The coating operation is carried out at a solution temperature ranging from room temperature to 50° C. The drying and baking operations are carried out at a temperature ranging from 100° to 500° C for 10 seconds to 10 minutes. Under such conditions, the chromium compound reacts with the non-ionic surface active agents and/or glycine as reducing agents to form a noncrystalline coating having excellent corrosion resistance and adhesion to top-coated paints.

This invention will be now illustrated by the following examples.

EXAMPLES 1 to 4

Cold-rolled steel plate (SPCC-D manufactured by Shin Nippon Seitetsu Co.) having a size of $0.8 \times 70 \times 150$ mm was degreased with an alkali, cleaned and mechanically polished. Separate plates were coated with chromating solutions having compositions as indicated in Table 1A by means of a roller, dried and baked for 6 minutes in an electrically heated forced air oven at a temperature ranging from 170° to 200° C to form a coating having a coating weight ranging from 170 to 190 mg/m$^2$. The corrosion resistance of the coated specimen was tested by the saline spraying test according to JIS-Z-2871 defined below.

Identically treated steel specimens were coated with a modified epoxy resin to a film thickness of $25 \pm 5$ microns and baked at 160° C for 20 minutes in a forced air oven to produce a coating having a pencil hardness of 3H as measured according to JIS-G-3312. These panels were tested for corrosion resistance and adhesion with a topcoated paint. For comparison purposes, control panels were treated with a chromate solution containing a non-ionic surfactant outside the scope of the invention and painted as above. Table 1B shows the results obtained in Examples 1 through 4 and in the comparative test.

Saline Spraying Test

The saline spraying test was carried out according to JIS-Z-2371. The specimens were diagonally scribed to the base metal surface from one corner to the other. The specimens were subjected to the 5% saline spraying test for a predetermined period of time and then transparent tape was applied along the scribe. The peeled-off width was measured after the tape was peeled off as rapidly as possible. Corrosion is so extensive for the unpainted surfaces that results are expressed as % of the total panel surface corroded.

Adhesion Test of Top-Coated Paint

The chromated specimen was indented to form 100 rectangular checks by scribing 11 lines at intervals of 1 mm in one direction and another 11 lines intersecting perpendicularly to the first set. The specimen was bent forward to a maximum distance of 5 mm against the opposite side of indented check by means of an Erichsen film tester according to JIS-B-7777. Transparent tape was applied and after the tape was peeled suddenly, the number of remaining checks of film was determined.

Table 1A

| Ex. No. | Chromating Solution Composition | Concentration g/l |
|---|---|---|
| 1 | $CrO_3$ | 40 |
| | $C_{12}H_{25}O(CH_2CH_2O)_7H$ | 5 |
| | $C_{13}H_{27}O(CH_2CH_2O)_7H$ | 5 |
| 2 | $CrO_3$ | 40 |
| | $C_{18}H_{35}O(CH_2CH_2O)_9H$ | 10 |
| 3 | $CrO_3$ | 40 |
| | ZnO | 16 |
| | 75% $H_3PO_4$ | 13 |
| | $C_{12}H_{25}O(CH_2CH_2O)_7H$ | 5 |
| | $C_{13}H_{27}O(CH_2CH_2O)_7H$ | 5 |
| 4 | $CrO_3$ | 40 |
| | Glycine | 20 |
| | $C_{12}H_{25}O(CH_2CH_2O)_7H$ | 0.25 |
| | $C_{13}H_{27}O(CH_2CH_2O)_7H$ | 0.25 |
| Control | $CrO_3$ | 40 |
| | $C_9H_{19}$—⟨benzene⟩—O—$(CH_2CH_2O)_{14}H$ | 10 |

TABLE 1B

| Ex. No. | Unpainted Surface: Saline Spraying Test % Corroded 1 hr | 2 hrs | 5 hrs | 6 hrs | 30 hrs | Painted Surface: Saline Spraying Test mm Creepage 240 hrs | 500 hrs | Adhesion —% Adherance |
|---|---|---|---|---|---|---|---|---|
| 1 | 0 | 5 | 5–10 | — | — | — | — | |
| 2 | 0–5 | 5–10 | 5–10 | — | — | | | |
| 3 | 0 | 0 | 0 | 0 | 8–10 | 0 | 0–0.5 mm | 98–100 |
| 4 | 0 | 0 | 0 | 0 | 5–10 | 0 | 0–0.5 | 98–100 |
| Control | 40–60 | 50–90 | 100 | 100 | 100 | 2.0 | 3.0–5.0 | 90–97 |

EXAMPLE 5

Steel plate pretreated in the same manner as in Example 1 was coated with a chromating solution comprising $CrO_3$ (40grams/liter), a mixture of $C_{12}H_{25}O(CH_2CH_2O)_7H$ and $C_{13}H_{27}O(CH_2CH_2O)_7H$ in a proportion of 1:1 (1 gram/liter, Inogen ET 147 Trademark of Dai Ichi Seiyaku Co.), 75% $H_3PO_4$ (20 grams/liter) and ZnO (16 grams/liter) and having a pH of 1.2 at 23° C by means of a roller and dried and baked for 6 minutes in an electrically heated forced air oven at 180° to 200° C to obtain a chromated steel plate having a coating weight of 160 to 190 mg/m². Table 2 shows results of the saline spraying test on the chromated specimens and those of corrosion and adhesion test on the chromated specimen coated with the epoxy primer in the same manner as in Example 1.

Table 2

| Ex. No. | Unpainted Surface: Saline Spraying Test % Corroded 2hrs | 4hrs | 6hrs | 24hrs | Painted Surface: Saline Spraying Test mm Creepage 240 hrs | 500 hrs | Adhesion —% Adherance |
|---|---|---|---|---|---|---|---|
| 5 | 0–5% | 10–20% | 10–20% | 100 % | 0–0.5 mm | 0.5–1.0mm | 80–90% |

EXAMPLES 6 to 7

Galvanized steel plate of 0.27 × 70 × 150 mm was cleaned and mechanically polished. The polished plate was then coated with chromating solutions having the compositions of Table 3A and dried and baked for 6 minutes in an electrically heated forced air oven at 180° to 200° C. Table 3B shows the results obtained by subjecting the plates to the saline spraying test and those obtained by subjecting the painted plate wherein the chromated plate was undercoated with an epoxide primer in a thickness of 5 microns and top-coated with an acrylic paint in a thickness of 13 to 15 microns to the corrosion test and adhesion test.

It has also been discovered that even further improvement can be achieved by coating the metal surface with a chromating solution additionally comprising urea. The amount of urea used ranges from 0.5 to 50 grams/liter, preferably 1 to 30 grams/liter.

EXAMPLES 8 to 9

Cold-rolled steel plate (SPCC-D) of 0.8 × 70 × 150 mm was cleaned with an alkaline degreasing solution and mechanically polished. The polished plate was coated with chromating solutions having the compositions of Table 4 by means of a rubber roller and dried and baked for 6 minutes in an electrically heated forced air oven at 170° to 200° C. The thus-treated plates were then coated with a zinc-rich paint (SD Zinc Primer ZE No. 100 prepared by Kansai Paints Co.) to a thickness from 15 to 20 microns and allowed to air dry. Table 4 shows the results obtained.

Table 3A

| Example No. | Composition | Chromating Solution Concentration, g/l | pH at 23° C |
|---|---|---|---|
| 6 | $CrO_3$ | 40 | |
| | $C_{12}H_{25}O(CH_2CH_2O)_7H$ | 5 | |
| | $C_{13}H_{27}O(CH_2CH_2O)_7H$ | 5 | 0 |
| | 75% $H_3PO_4$ | 20 | |
| | ZnO | 1.5 | |
| 7 | $CrO_3$ | 40 | |
| | $C_{12}H_{25}O(CH_2CH_2O)_7H$ | 5 | |
| | $C_{13}H_{27}O(CH_2CH_2O)_7H$ | 5 | |
| | Glycine | 23 | 2.1 |
| | 75% $H_3PO_4$ | 20 | |
| | ZnO | 16 | |

Table 3B

| Example No. | Unpainted Surface: Saline Spraying Test —% Corroded | | | | Painted Surface: Saline Spraying Test —mm Creepage | | Adhesion —%Adherence |
|---|---|---|---|---|---|---|---|
| | 6hrs | 24hrs | 72hrs | 120hrs | 500hrs | 1500hrs | |
| 6 | 0 | 0 | 0 | 0 | 0 mm | 1.0–2.5mm | 99–100 |
| 7 | 0 | 0 | 0–5 | 10 | 0 | 1.0–2.5 | 96–99 |

Table 4

| Example No. | Chromating Solution: Composition | Concentration, g/l | Salt Spray Corrosion Resistance after 500 hrs —mm creepage |
|---|---|---|---|
| 8 | $CrO_3$ | 40 | Q mm |
| | $C_{12}H_{25}O(CH_2CH_2O)_7H$ | 5 | |
| | $C_{13}H_{27}O(CH_2CH_2O)_7H$ | 5 | |
| | $NH_2CONH_2$ | 20 | |
| 9 | $CrO_3$ | 40 | 0 |
| | Glycine | 20 | |
| | $NH_2CONH_2$ | 20 | |
| | $C_{12}H_{25}O(CH_2CH_2O)_7H$ | 0.25 | |
| | $C_{13}H_{27}O(CH_2CH_2O)_7H$ | 0.25 | |

We claim:

1. An aqueous composition suitable for imparting corrosion resistance to a metal surface comprising a nexavalent chromium compound and from 1 to 30 g/l of non-ionic surfactants of the formula $$RO(CH_2CH_2O)_nH$$

wherein R = a saturated or unsaturated aliphatic radical of 5 to 25 carbon atoms, $n$ = 2 to 30 and glycine in a concentration of from 1 to 50 g/l.

2. The composition of claim 1 wherein the hexavalent chromium content is 1–200 g/l.

3. The composition of claim 1 additionally comprising 0.5 to 50 g/l of urea.

4. An aqueous concentrate composition comprising the components of claim 1 with a hexavalent chromium content in excess of 200 g/l.

5. A process for imparting corrosion resistance to a metal surface comprising contacting the surface with the composition of claim 1 and thereafter drying the thus-coated surface.

6. The process of claim 5 wherein the thus-treated surface is dried at a temperature between 100°and 500° C.

* * * * *